United States Patent [19]

Arvizu et al.

[11] Patent Number: 4,746,044

[45] Date of Patent: May 24, 1988

[54] BACK-PACK WITH STAND AND DETACHABLE CHILD CARRIER

[76] Inventors: Juarez D. Arvizu; Edna I. Arvizu, both of 105 Giffen, San Manuel, Ariz. 85631

[21] Appl. No.: 942,607

[22] Filed: Dec. 17, 1986

[51] Int. Cl.[4] ..... A45F 4/02; A47D 13/02

[52] U.S. Cl. ..... 224/161; 224/155; 224/262; 224/211; 297/217

[58] Field of Search ..... 224/151, 155, 158, 159, 224/160, 161, 259, 261, 262, 263, 264, 265, 266, 201, 202, 209, 210, 211, 212, 213, 214, 215, 216; 297/1, 195, 118, 129, 217

[56] References Cited

U.S. PATENT DOCUMENTS

| | | | |
|---|---|---|---|
| 2,690,208 | 9/1954 | Mary | 297/195 |
| 3,097,773 | 7/1963 | Cunningham | 224/161 |
| 3,421,670 | 1/1969 | Hansson | 224/161 |
| 3,610,489 | 10/1971 | Parsons | 224/161 |
| 3,679,107 | 7/1972 | Perrine | 224/265 |
| 3,713,568 | 1/1973 | Sloan | 224/161 |
| 3,863,978 | 2/1975 | Gillings, Jr. | 297/195 X |
| 3,968,910 | 7/1976 | Dye et al. | 224/161 |
| 3,989,173 | 11/1976 | Gebhard | 224/155 |
| 4,044,931 | 8/1977 | Catelli | 224/161 |
| 4,157,837 | 6/1979 | Kao | 224/161 X |
| 4,416,403 | 11/1983 | Johnson | 224/161 |
| 4,484,700 | 11/1984 | Bush | 226/161 |
| 4,676,466 | 6/1987 | Nakao et al. | 224/160 X |

FOREIGN PATENT DOCUMENTS

| | | | |
|---|---|---|---|
| 1184355 | 7/1959 | France | 224/259 |
| 61077 | 7/1939 | Norway | 224/161 |
| 88083 | 8/1956 | Norway | 224/151 |

OTHER PUBLICATIONS

Time Mirror Magazines, Inc., "What's New", *Outdoor Life*, Jul. 1987, p. 19.

*Primary Examiner*—Henry J. Recla
*Assistant Examiner*—Ernest G. Cusick
*Attorney, Agent, or Firm*—Harry M. Weiss & Assoc.

[57] ABSTRACT

An improved back pack and shoulder child carrier apparatus including a solid, lightweight constructed child carrier detachably mounted to a horizontal tubular platform on the top portion of a back pack frame structure for a more uniform distribution of the child's weight throughout the upper and lower back of the adult. The majority of the weight being forced toward the upper back due to an improved seat structure having a frontwardly provided saddle bow and a saddle bow collar cutout, the saddle bow also provides added support about the crotch of the child being carried. The minority of the child's weight is then uniformly distributed downwardly to the adult's lower back by the side frame members which extend rearwardly then downwardly towards the lower back of the adult wearer. A feature to improve wear is further provided by detachable and washable leg flaps which attach between the seat and the child carrier mounting platform and which prevent soiling the clothes of the adult by the feet of the child being carried. The back pack frame structure is further enhanced by providing a hingeably attached rear stand to enable the structure to stand in an upright position when not in use. Still further enhancement to the back pack frame structure includes a swivel-type of shoulder hooks attachment harness which provides an alternate method of harnessing the device to the adult wearer.

6 Claims, 3 Drawing Sheets

BACK-PACK WITH STAND AND DETACHABLE CHILD CARRIER

FIELD OF THE INVENTION

The present invention relates to a new or improved back-pack and detachable child carrier combination which enables an adult to comfortably carry a child seated upon the shoulders while also carrying a loaded back pack.

DESCRIPTION OF THE PRIOR ART

Although devices which combine the attributes of a back pack and a child carrier are known in the art, none have achieved a satisfactory solution to the comfort requirements of both the adult carrying the device and the child being carried in the carrier attached to the back pack portion of the device.

Prior art such as U.S. Pat. No. 3,610,489 discloses a child carrier which is removably mounted by suitable braces to a back pack frame of the type having upright, tubular side frame members. U.S. Pat. No. 4,416,403 discloses a vertically adjustable over-the-shoulder carrier attached to a simple back pack frame structure. The fit about the neck of the adult and about the crotch of the child is of questionable comfort over a normal period of use. Also, due to the soft material proposed and used by the prior art for construction of the child seat, the weight of the child being carried is concentrated at the attachment points on the back pack frame structure where the soft seat material attaches instead of being broadly distributed throughout the back of the adult between the shoulders and hips of the adult. Such devices have also neglected to enhance the frame structure of the back pack portion to allow the adult to stand the device in the upright position or to provide an enhanced harnessing means for attaching the device in an alternative manner different than the conventional straps used in attaching a back pack.

Consequently, a need exists for a child carrier and back pack device which will provide comfort for both the child being carried and the adult doing the carrying and which will uniformly distribute the weight of the child throughout the back of the adult between the shoulders and hips. Additionally, the frame structure of such child carrier and back pack devices need to have a stand to allow such devices to be placed in an upright position when not being used. Further, such devices need to be provided with alternative harnessing means to accomodate a user wanting an alternative to the conventional strap harnesses.

SUMMARY OF THE INVENTION

A primary object of the invention is directed at providing an improved back pack having a shoulder-level, detachably mounted child carrier, the improvements comprising a solid, broad-base and more comfortable child carrier and an enhanced back pack frame structure which provides a platform top portion for detachable mounting of the improved child carrier, a hingeably attached rear stand member which enables the back pack to stand in an upright position when not in use and a harnessing arrangement which provides an alternative method of wearing the back pack.

The improved back pack frame structure having a frontal portion which is the portion closest to the back of the adult wearer and a rear portion which is the furthest portion from the back of the adult wearer. The back pack frame structure is provided at the top with a horizontal platform having a plurality of cross support members for detachably mounting the improved child carrier and further provided with right and left side frame members which curve from the rear of the platform downward and towards the front to define the lower part of the frontal portion of the frame structure. Each right and left side member is provided near the top and towards the rear with a hingeably attached rear leg member which in combination form a rear stand which when extended will complement the frame structure frontal portion to enable the entire back pack frame structure to stand in an upright position when not in use. The improved back pack harnessing arrangement is comprised of a pair of multi-position, swivel-latched shoulder hooks independently attached to the upper left and right side of the frontal portion of the frame structure. Each shoulder hook is provided with a means for attaching to straps which crisscross the chest of the adult wearer from the lower part of the frontal portion of the frame structure.

The improved child carrier which detachably attaches to the horizontal platform of the back pack frame structure is preferably constructed of solid, lightweight material such as tubular aluminum material. The horizontal platform mounting technique along with the rear-to-front curving construction of the right and left side frame members will help to distribute the weight of the child being carried throughout the upper and lower back of the adult using the back pack and child carrier apparatus. Additionally, to improve on the weight distribution, the seat portion is constructed having a shortened depth in order to force the center of gravity of the child being carried toward the front and thereby cause the majority of the child's weight to be across the upper back of the adult. To further improve on the weight distribution, the front portion of the seat is provided with a saddle bow to maintain an even weight distribution between the left and right side of the adult wearer's back. The saddle bow will also provide crotch support for the child being carried and thus makes the seat more comfortable. Another enhancement to the manner in which the child's weight is distributed is accomplished by constructing the seat's saddle bow with a collar cutout to allow a comfortable forward fitting of the child carrier toward the neck of the adult wearing the device. Further, the child carrier and back pack apparatus is provided at the front side with a detachable, washable leg flap which will drape over the shoulder and breast of the adult wearer to prevent soiling of his or her clothes.

Accordingly, the present invention relates to an improved back pack and shoulder child carrier combination which increases the comfort of the child being carried and the adult doing the carrying by providing a carrier which is of solid and lightweight construction and is detachably mounted to a horizontal platform on the top portion of a back pack frame structure for a more uniform distribution of the child's weight throughout the upper and lower back of the adult. The majority of the weight being forced toward the upper back due to a shortened and adjustably mounted seat structure having a saddle bow collar cutout, then evenly distributed between the right and left upper back due to a saddle bow in the front portion of the seat. The saddle bow also provides added support about the crotch of the child being carried. The minority of the child's weight is then uniformly distributed downwardly to the adult's lower back by virtue of the solid construction of the carrier and the manner in which the weight is imparted to the horizontal platform and the curving right and left side frame members. An attribute to improve wear is further provided by detachable and washable leg flaps which attach to the front portion of the apparatus and which prevent soiling the clothes of the adult by the feet of the child being carried. The back pack frame structure is further enhanced by providing a hingeably attached rear stand to enable the structure to stand in an upright position when not in use. Still further enhancement to the back pack frame structure includes a swivel-type of shoulder hooks attachment harness which provides an alternate method of harnessing the device to the adult wearer.

Therefore to the accomplishments of the foregoing objects, the invention consists of the features hereinafter fully described and particularly pointed out in the claims, the accompanying drawings and following disclosure describing in detail the invention, such drawings and disclosure illustrating, however, but one of the various ways in which the invention may be practiced.

DETAILED DESCRIPTION OF THE PREFERRED EMBODIMENT

Figure 1:
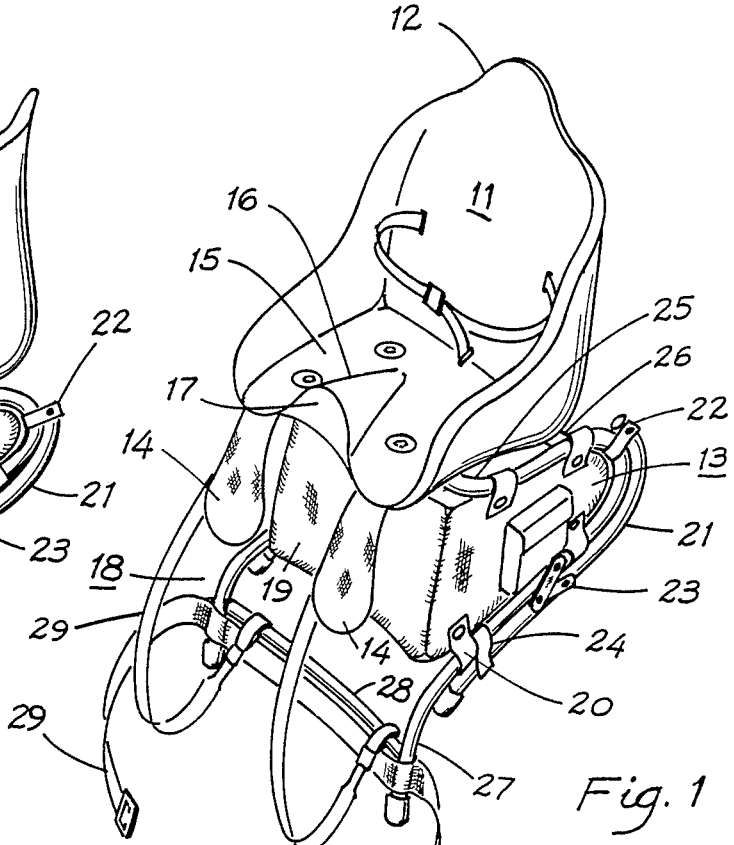
FIG. 1 is a perspective view of the preferred embodiment of the invention shown with a conventional strap harness, the hingeably attached rear stand in a secured manner, and the shortened seat with saddle bow and leg flaps.

Referring now to the drawings, and more particularly to FIG. 1, there is shown the improved back pack and child carrier assembly 11 having a shoulder-level, detachably mounted child carrier 12, a back pack and back pack structure 13 and removably secured therebetween, a pair of leg flaps 14 provided to protect the adult's clothing from getting soiled from the feet of the child being carried. Child carrier 12 having a modified seat portion 15 including a saddle bow 16, saddle bow collar cutout 17, child carrier 12 being preferably fabricated from a rigid, lightweight and durable plastic. The back pack and back pack structure 13 including major back pack frame structure 18 and removably attached back pack 19, back pack 19 being preferably attached to frame structure 18 using a plurality of snapable straps 20. Frame structure 18 defining a platform means for detachably mounting a child carrier. Frame structure 18 being modified by having appended a hingeably attached rear stand 21, stand 21 being hingeably secured to frame structure 18 by hinges 22, latchable brackets 23 and clips 24. As can best be seen from FIG. 9, hingeably attached rear stand 21 being appended to side members 27 such that when stand 21 is unfolded, stand 21 complements side members 27 to enable frame structure 18 to stand in an upright position. Frame structure 18 and rear stand 21 being constructed of a lightweight tubular material such as aluminum.

Figure 4:
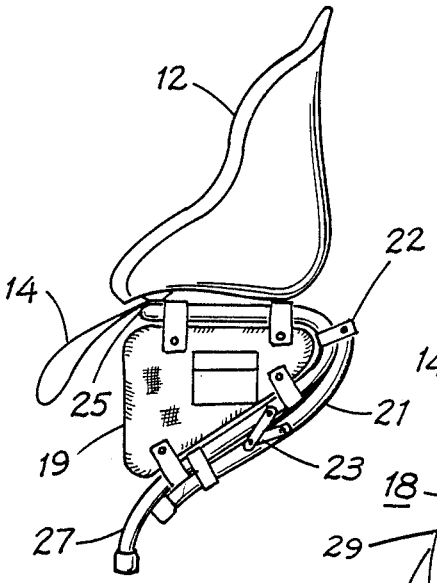
FIG. 4 is a side elevation view of the preferred embodiment of the invention.
Figure 2:
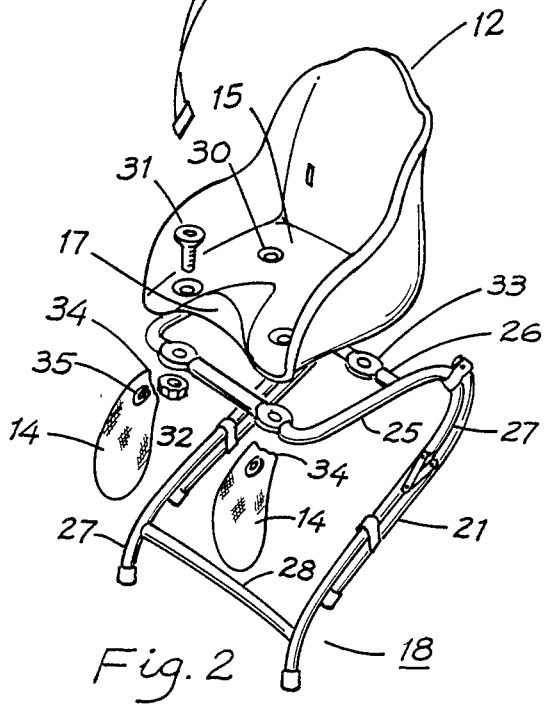
FIG. 2 is an exploded assembly view showing attachment of the shortened seat to the top platform portion of the back pack frame structure.

As can best be seen from FIG. 2, frame structure 18 is best constructed to accomodate the invention by having a horizontal U-shaped top platform 25, including upper cross support and seat mounting member 26, rearwardly and downwardly curving parallel side members 27 and bottom frame support cross member 28, side members 27 curving forwardly and terminating vertically at a vertical plane which extends upward to front of platform 25, see FIG. 4. In the embodiment shown in FIG. 1 and in use at FIG. 3, a simple strap shoulder harness and belt arrangement 29 is attached to frame structure 18 at front of U-shaped top platform 25 and at bottom frame cross member 28. Also shown in FIG. 2, child carrier 12 attaches to slotted mounting holes 33 on platform 25 and cross member 26 using recessed holes 30 on seat portion 15, bolts 31 and nuts 32, slotted holes 33 allowing for forward and backward adjustment of carrier 12 within the curvature of saddle bow collar cutout 17. Leg flaps 14, having attachment ends 34, may also be attached between seat 15 and platform 25 using bolts 31 and nuts 32. Since Leg flaps 14 are preferably made of a cool, washable fabric material, the attachment method may include snap buttons 35 for faster removal.

Figure 3:
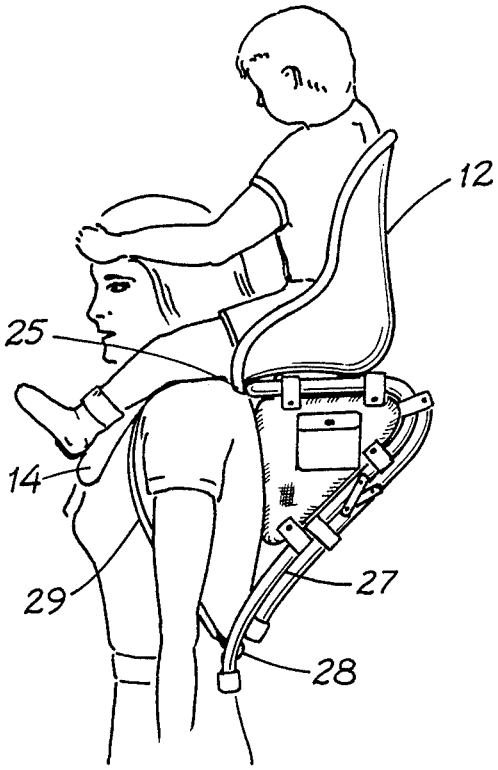
FIG. 3 is a perspective view of the preferred embodiment of the invention in use.

Referring to FIG. 3 and FIG. 4, whereat the weight distribution improvement is best illustrated, seat portion 15 is shown having a shortened depth such that the center of gravity of the child being carried is forced toward the front part of U-shaped top platform 25 and toward the upper back of the adult. Also, by providing saddle bow collar cutout 17 and adjustable mounting holes 33 on platform 25, a comfortable forward fitting of the child carrier toward the neck of the adult wearing the device is enabled. Further, a portion of the child's weight will be distributed to the lower back by platform 25 used to mount seat 15 and rearward and downward curving side members 27. Thus, the majority of the child's weight is forced toward the upper back due to a shortened seat structure 15, collar cutout 17 and slotted adjustment holes 33, then evenly distributed between the right and left upper back due to saddle bow 16, the minority of the child's weight is then uniformly distributed downwardly to the adult's lower back due to solid construction of carrier 12 and horizontal attachment to horizontal platform 25 and downward curving side members 27.

Figure 5:
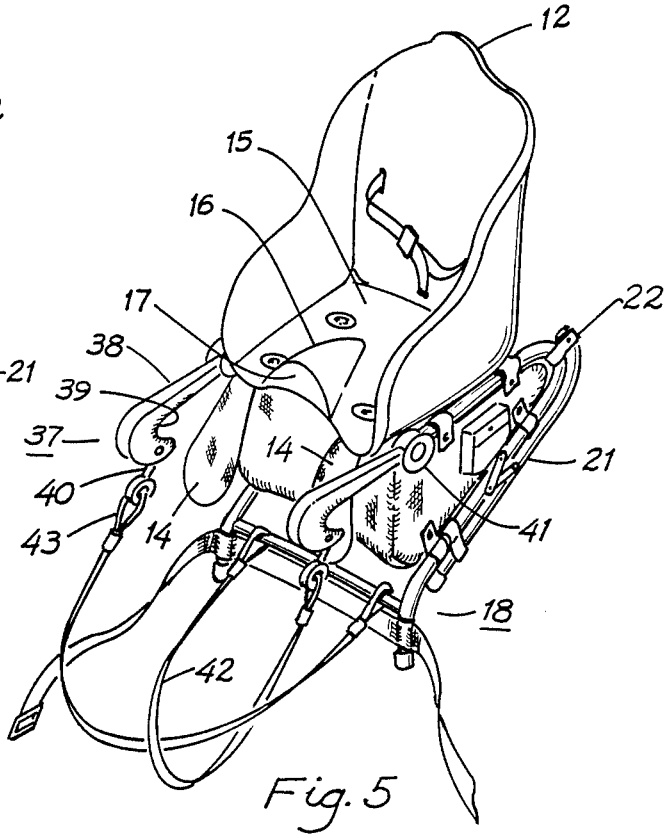
FIG. 5 is a perspective view showing an alternative embodiment whereby the harness is comprised of a swivel-type shoulder hook and criss cross strap arrangement.

Referring to FIG. 5, there is shown a further embodiment 36 of the invention, wherein a further enhancement to the back pack frame structure 18 includes a swivel-type, shoulder hook attachment harness, shown generally at 37, comprising shoulder hooks 38, padded hook ends 39, eyelet bolts 40, multi-position swivel latches 41, criss-cross straps 42 and eyelet bolt latches 43. The enhancement provides an alternate method of harnessing the device to the adult wearer and would replace the more standard straps 29 used in embodiment 11 shown in FIG. 1.

Figure 7:
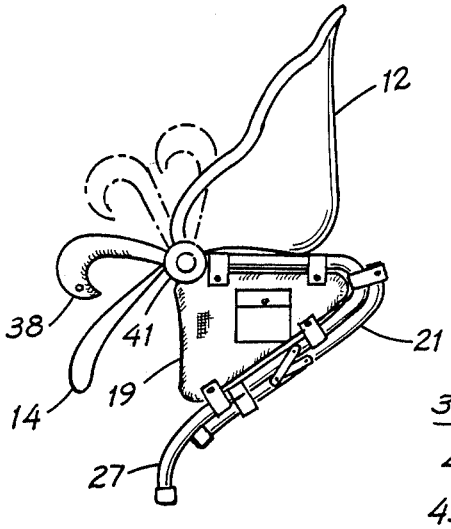
FIG. 7 shows a side elevation view of the alternative embodiment of the invention.
Figure 8:
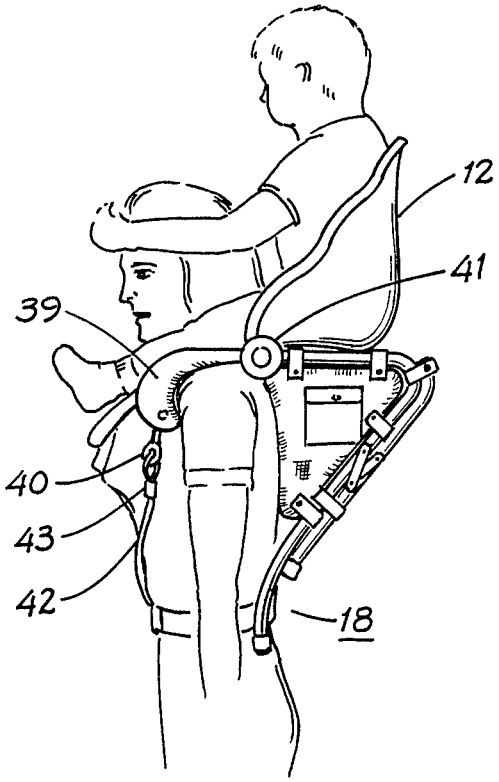
FIG. 8 is a perspective view of the alternative embodiment of the invention in use.
Figure 6:
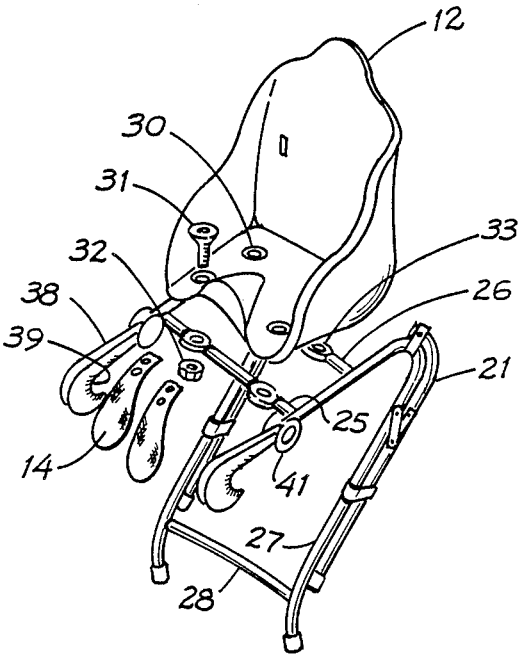
FIG. 6 shows an exploded assembly view of the alternative embodiment showing the detachable feature of the seat from the top platform portion of the back pack frame structure.
Figure 9:
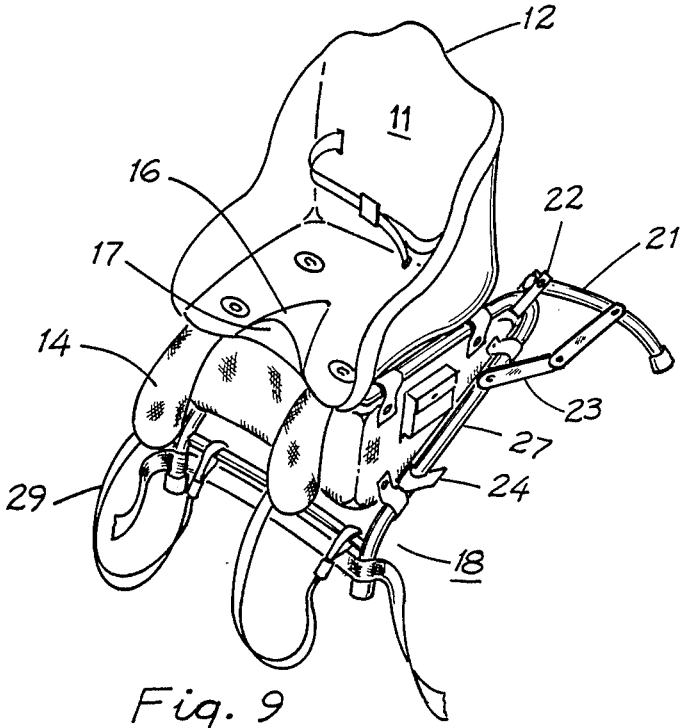
FIG. 9 is a perspective view of the preferred embodiment of the invention in a upright standing position shown utilizing the hingeably attached rear stand.
Figure 10:
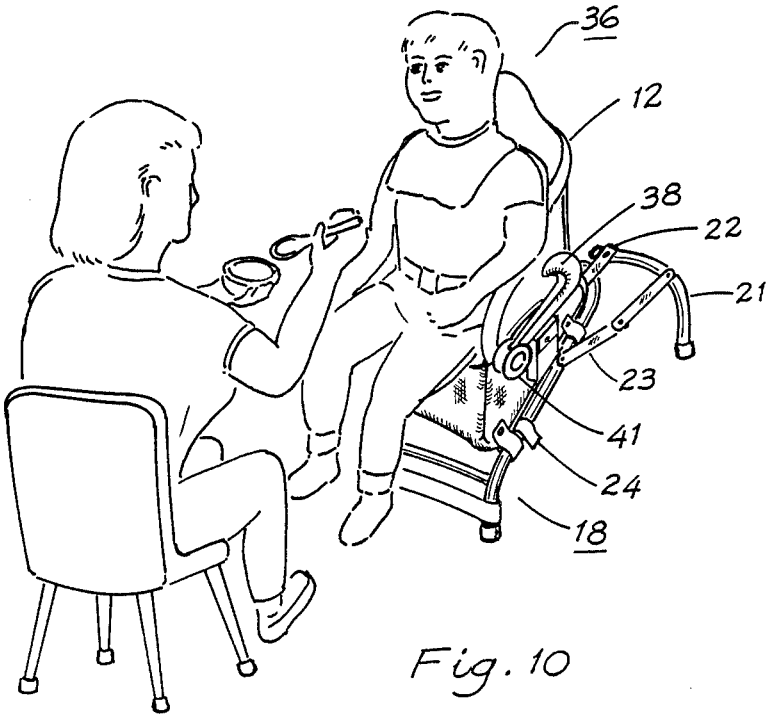
FIG. 10 is a perspective view of the alternative embodiment of the invention in an upright standing position shown utilizing the hingeably attached rear stand and a suggested use.

FIG. 6 shows the assemblage of embodiment 36 to be similar to the assemblage of embodiment 11, shoulder hooks 38 and latches 41 being attached frontwardly and at each side of platform 25 and thereby allowing mounting of carrier 12 therebetween. FIG. 7 shows shoulder hooks 38 in a plurality of rotationally latched positions made possible by multi-position latches 41. FIG. 8 shows embodiment 36 in use whereby shoulder hooks 38, having padded hook ends 39, are latched in position and comfortably draped over the adult's shoulders. Shown also are criss-cross straps 42, with latches 43 attached to eyelet bolts 40 to further secure back pack structure 18 to the adult. FIG. 9 shows the preferred embodiment 11 in an upright position whereby rear stand 21 is extended at hinges 22 and latched in place with latches 23. Similarly, FIG. 10 shows the alternative embodiment 36 in an upright position with rear stand 21 extended using hinges 22 and latched in place with latches 23. FIG. 10 additionally shows a suggested use for embodiment 36 whereby a child is seated and being fed by an adult.

Therefore, while the present invention has been shown and described herein in what is conceived to be the most practical and preferred embodiment, it is recognized that departures can be made therefrom within the scope of the invention, which is therefore not to be limited to the details disclosed herein but is to be accorded the full scope of the claims so as to embrace any and all equivalent devices.

I claim:

1. An improved back pack and detachable shoulder child carrier apparatus, comprising:

a rigid and lightweight back pack frame structure adapted with a platform means for detachably mounting a child carrier, a pair of laterally spaced side members, a rear leg stand hingeably attached to said laterally spaced side members, said back pack frame structure being designed for an adult wearer such that said platform means will fit rearwardly at shoulder level on the back of said adult wearer, said platform means having a front portion being proximate to the back of said adult wearer and a rear portion being farther from said back than said front portion, said platform means also having a plurality of platform support members, said platform support members being adapted with a plurality of child carrier mounting holes, said pair of laterally spaced side members extending closer from said rear portion of said platform means and then curving frontwardly in a direction of the front portion and terminating vertically at a vertical plane perpendicular to said front portion of said platform means to form a front leg portion for said back pack frame structure, said front leg portion having a lower end, said front leg portion having a cross support member between said pair of laterally spaced side members, said pair of laterally spaced side members further being provided with clip attachment means for detachably securing thereto said rear leg stand when not being used, said rear leg stand being latchably and rearwardly extendable from said laterally spaced side members to complement said front leg portion to enable said back pack frame structure to stand in an upright position;

a child carrier constructed of lightweight material, such as plastic, detachably mounted to said platform means, including a seat having a seat front portion provided with a saddle bow for improved crotch support for a child being carried and also to improve the weight distribution of said carrier between the left and right side of said adult wearer's back when said child carrier is connected to said frame structure, said saddle bow having a collar cutout portion formed to allow forward adjustment of said seat and thus provide a more comfortable fit of said child carrier about the neck and shoulders of said adult wearer;

a pair of leg flaps detachably mounted between said seat and said platform means, said leg flaps being manufactured from a cool, lightweight and washable fabric and used to protect said adult wearer's clothing from getting soiled while carrying a child; and a back pack attached to said frame structure.

2. An improved back pack and detachable shoulder child carrier apparatus as recited in claim 1, further comprising:

said back pack for carrying a load, said back pack being provided with a plurality of straps having ends suitably terminated for detachably mounting beneath said platform means and to said pair of laterally spaced side members.

3. An improved back pack and detachable shoulder child carrier apparatus as recited in claim 1, further comprising:

a shoulder strap harness means, including a length adjustable, right and left side shoulder straps having upper ends and lower ends attached at said upper ends at said front portion of said platform means and attached at said lower ends at said cross support member of said front leg portion of said frame structure, and a belt loop portion attached in a cross support manner at said lower end of said front leg portion.

4. An improved back pack and detachable shoulder child carrier apparatus as recited in claim 1, further comprising:

a shoulder hook harness means, including a pair of elongated arms, a multi-position, swivel-type latch and crisscrossing length adjustable shoulder straps, each said elongated arm having a shoulder contact side, an end terminating in a downward hook manner and other end attached to said multi-position, swivel-type latch, said latch being attached to said front portion of said platform means, said elongated arms being provided with a soft padding material on said shoulder contact side, each said arm end terminating in a downward hook manner also being provided with an eyelet bolt for detachable securement to a corresponding eyelet bolt latch means attached to said length adjustable crisscrossing straps, said crisscrossing straps also being attached at said cross support member of said front leg portion.

5. An improved back pack and detachable shoulder child carrier apparatus, comprising:

a rigid and lightweight back pack frame structure adapted with a platform means for detachably mounting a child carrier, a pair of laterally spaced side members, a rear leg stand hingeably attached to said laterally spaced side members, said back pack frame structure being designed for an adult wearer such that said platform means will fit rearwardly at shoulder level on the back of said adult wearer, said platform means having a front portion being proximate to the back of said adult wearer and a rear portion being farther from said back than said front portion, said platform means also having a plurality of platform support members, said platform support members being adapted with a plurality of child carrier mounting holes, said pair of laterally spaced side members extending closer from said rear portion of said platform means and then curving frontwardly in a direction of the front portion and terminating vertically at a vertical plane perpendicular to said front portion of said platform means to form a front leg portion for said back pack frame structure, said front leg portion having a lower end, said front leg portion having a cross support member between said pair of laterally spaced side members, said pair of laterally spaced side members further being provided with clip attachment means for detachably securing thereto said rear leg stand when not being used, said rear leg stand being latchably and rearwardly extendable from said laterally spaced side members to complement said front leg portion to enable said back pack frame structure to stand in an upright position;

a child carrier constructed of lightweight material, such as plastic, detachably mounted to said platform means, including a seat having a seat front portion provided with a saddle bow for improved crotch support for a child being carried and also to improve the weight distribution of said carrier between the left and right side of said adult wearer's back when said child carrier is connected to said frame structure, said saddle bow having a collar cutout portion formed to allow forward adjustment of said seat and thus provide a more comfortable fit of said child carrier about the neck and shoulders of said adult wearer;

a pair of leg flaps detachably mounted between said seat and said platform means, said leg flaps being manufactured from a cool, lightweight and washable fabric and used to protect said adult wearer's clothing from getting soiled while carrying a child; a back pack for carrying a load, said back pack being provided with a plurality of straps having ends suitably terminated for detachably mounting beneath said platform means and to said pair of laterally spaced side members; and a shoulder strap harness means, including a length adjustable, right and left side shoulder straps having upper ends and lower ends attached at said upper ends at said front portion of said platform means and attached at said lower ends at said cross support member of said front leg portion of said frame structure, and a belt loop portion attached in a cross support manner at said lower end of said front leg portion.

6. An improved back pack and detachable shoulder child carrier apparatus, comprising:

a rigid and lightweight back pack frame structure adapted with a platform means for detachably mounting a child carrier, a pair of laterally spaced side members, a rear leg stand hingeably attached to said laterally spaced side members, said back pack frame structure being designed for an adult wearer such that said platform means will fit rearwardly at shoulder level on the back of said adult wearer, said platform means having a front portion being proximate to the back of said adult wearer and a rear portion being farther from said back than said front portion, said platform means also having a plurality of platform support members, said platform support members being adapted with a plurality of child carrier mounting holes, said pair of laterally spaced side members extending closer from said rear portion of said platform means and then curving frontwardly in a direction of the front portion and terminating vertically at a vertical plane perpendicular to said front portion of said platform means to form a front leg portion for said back pack frame structure, said front leg portion having a lower end, said front leg portion having a cross support member between said pair of laterally spaced side members, said pair of laterally spaced side members further being provided with clip attachment means for detachably securing thereto said rear leg stand when not being used, said rear leg stand being latchably and rearwardly extendable from said laterally spaced side members to complement said front leg portion to enable said back pack frame structure to stand in an upright position; a child carrier constructed of lightweight material, such as plastic, detachably mounted to said platform means, including a seat having a seat front portion provided with a saddle bow for improved crotch support for a child being carried and also to improve the weight distribution of said carrier between the left and right side of said adult wearer's back when said child carrier is connected to said frame structure, said saddle bow having a collar cutout portion formed to allow forward adjustment of said seat and thus provide a more comfortable fit of said child carrier about the neck and shoulders of said adult wearer; a pair of leg flaps detachably mounted between said seat and said platform means, said leg flaps being manufactured from a cool, lightweight and washable fabric and used to protect said adult wearer's clothing from getting soiled while carrying a child; a back pack for carrying a load, said back pack being provided with a plurality of straps having ends suitably terminated for detachably mounting beneath said platform means and to said pair of laterally spaced side members; and a shoulder hook harness means, including a pair of elongated arms, a multi-position, swivel-type latch and crisscrossing length adjustable shoulder straps, each said elongated arm having a shoulder contact side, an end terminating in a downward hook manner and other end attached to said multi-position, swivel-type latch, said latch being attached to said front portion of said platform means, said elongated arms being provided with a soft padding material on said shoulder contact side, each said arm end terminating in a downward hook manner also being provided with an eyelet bolt for detachable securement to a corresponding eyelet bolt latch means attached to said length adjustable crisscrossing straps, said crisscrossing straps also being attached at said cross support member of said front leg portion.

* * * * *